US008037561B2

(12) United States Patent
Austwick et al.

(10) Patent No.: US 8,037,561 B2
(45) Date of Patent: Oct. 18, 2011

(54) MAT FOR CHANGING DIAPER

(76) Inventors: Stephen Austwick, Tokyo (JP); Akiko Austwick, Tokyo (JP)

( * ) Notice: Subject to any disclaimer, the term of this patent is extended or adjusted under 35 U.S.C. 154(b) by 385 days.

(21) Appl. No.: 11/997,704

(22) PCT Filed: Jun. 15, 2006

(86) PCT No.: PCT/JP2006/311984

§ 371 (c)(1),
(2), (4) Date: Jan. 7, 2009

(87) PCT Pub. No.: WO2007/015340

PCT Pub. Date: Feb. 8, 2007

(65) Prior Publication Data

US 2009/0127307 A1 May 21, 2009

(30) Foreign Application Priority Data

Aug. 2, 2005 (JP) ..... 2005-224056

(51) Int. Cl.
*A47D 13/08* (2006.01)
*A47G 9/06* (2006.01)

(52) U.S. Cl. ..... 5/655; 5/417

(58) Field of Classification Search ..... 5/655, 417, 5/419, 420; 190/1, 2; 383/4; 224/576, 577
See application file for complete search history.

(56) References Cited

U.S. PATENT DOCUMENTS

| | | | | |
|---|---|---|---|---|
| 3,489,194 | A * | 1/1970 | Hoover | 383/4 |
| 4,068,786 | A * | 1/1978 | Taniguchi | 224/577 |
| 4,147,828 | A * | 4/1979 | Heckel et al. | 442/30 |
| 4,154,323 | A * | 5/1979 | Sneider | 190/2 |
| 4,723,300 | A * | 2/1988 | Aranow | 383/4 |
| 4,886,150 | A * | 12/1989 | Fitzsimmons | 190/1 |
| 4,905,990 | A * | 3/1990 | DeSantis | 482/23 |
| 5,649,658 | A * | 7/1997 | Hoffman et al. | 224/576 |
| 5,692,257 | A * | 12/1997 | Albertieri | 5/655 |
| 6,053,634 | A * | 4/2000 | Kay | 383/4 |
| 6,981,289 | B2 * | 1/2006 | Mueller et al. | 5/655 |
| 2009/0127307 | A1 * | 5/2009 | Austwick et al. | 224/577 |

FOREIGN PATENT DOCUMENTS

| | | | |
|---|---|---|---|
| JP | 57-99424 | A | 6/1982 |
| JP | 63-191922 | A | 12/1988 |
| JP | 3-60526 | A | 6/1991 |
| JP | 8-154974 | A | 6/1996 |
| JP | 3037681 | A | 3/1997 |
| JP | 10-57413 | A | 3/1998 |
| JP | 2004-535875 | A | 12/2004 |
| JP | 2005-21625 | A | 1/2005 |

* cited by examiner

*Primary Examiner* — Robert G Santos
(74) *Attorney, Agent, or Firm* — Sughrue Mion, PLLC

(57) ABSTRACT

An objective of the present invention is to provide a diaper change mat which has excellent workability and facilitates changing diapers. A diaper change mat according to the present invention includes surface fasteners (101 to 105 and 101' to 105') configured to be fastened detachably to a diaper and a mat (11) on which the surface fasteners (101 to 105 and 101' to 105') are fixed. The surface fasteners (101 to 105 and 101' to 105') are preferably convex members of surface fasteners and the convex members are fastened to nonwoven fabric used for a disposable diaper. The convex members of the surface fasteners are sheets provided with many engaging members of convex shape such as hooked or mushroom shaped, or the like. The surface fasteners (101 to 105 and 101' to 105') can fix a diaper (2) in a spread state to the mat (11), and thus help facilitate changing diapers.

10 Claims, 8 Drawing Sheets

MAT FOR CHANGING DIAPER

TECHNICAL FIELD

The present invention relates to a diaper change mat which is laid under a diaper wearer when changing diapers.

BACKGROUND ART

A diaper change mat is conventionally known as a tool which is laid under a baby or infant when changing diapers. When changing diapers for the baby or infant, one hand is devoted to holding the baby or infant, and thus, there is a problem that the changing work takes a long time due to the instability of the work done by a single hand Japanese Laid Open Patent Application (JP-P 2005-21625A) discloses a diaper change tool for a baby or infant. The diaper change tool can solve the problem in changing diapers by having a structure in which a hard plate, to which a fixing belt for holding the baby or infant is attached, is fixed at one end to a hard plate body attached detachably to the center of a foldable cloth mat such that the hard plate can lean forward, and a structure in which side portions of the plate body are separable to widen the plate body.

Also, Japanese Laid Open Patent Application (JP-A-Heisei, 8-154974) discloses a disposable diaper including: a liquid permeable top sheet; a liquid impermeable back sheet; an absorbing material between the sheets; and a fastening tape for fixing the diaper to a wearer, wherein no target tape, to which the fastening tape is fastened, is on a surface of the back sheet and the fastening tape is fastened to the surface of the back sheet. The disposable diaper is not subjected to a restriction of the fastening tape being fastened to the target tape, so that the size of the diaper can be freely adjusted.

Further more, Japanese Laid Open Patent Application (JP-A-Heisei, 10-57413) discloses a disposable diaper of an unfolded type employing nonwoven fabric for a surface of a back sheet, and including a fastening portion which can be fastened detachably to the back sheet. Japanese Laid Open Patent Application (JP-A-Heisei, 10-57413) describes that a convex member of publicly known (commercially available) surface fasteners can be used as the fastening portion without particular limitation. The convex member is a sheet provided with many engaging members of convex shape such as hooked or mushroom shaped, or the like.

DISCLOSURE OF INVENTION

An objective of the present invention is to provide a diaper change mat which has excellent workability and facilitates changing diapers.

A diaper change mat according to the present invention includes surface fasteners (101 to 105 and 101' to 105') which are configured to be fastened to detachably to a diaper; and a mat (11) on which the surface fasteners (101 to 105 and 101' to 105') are fixed.

On the diaper change mat according to the present invention, the surface fasteners (101 to 105 and 101' to 105') are preferably convex members of surface fasteners. The convex members are fastened detachably to nonwoven fabric used for a disposable diaper.

The diaper change mat according to the present invention may include a protecting cover (41) attached to a mat (11). The protecting cover (41) includes a fastening surface formed of nonwoven fabric which is fastened detachably to the surface fasteners (101 to 105 and 101' to 105'). The protecting cover (41) can cover the surface fasteners (101 to 105 and 101' to 105').

On the diaper change mat according to the present invention, preferably, the surface fasteners (101 to 105 and 101' to 105') are respectively provided in a plurality of positions on one of two principal surfaces of the mat (11).

On the diaper change mat according to the present invention, the mat (11) may have a substantially rectangular shape. Two of the plurality of positions (e.g., positions where the surface fasteners (105 and 105') are provided) are preferably symmetrically arranged with respect to a center line of the mat (11), the center line is parallel to long sides (11*x* and 11*z*) of the mat (11).

The diaper change mat according to the present invention preferably includes a carrying bag (51) configured to accommodate the mat (11). In this case, the mat (11) is configured to be folded and is coupled to inside of the carrying bag (51).

The diaper change mat according to the present invention preferably includes an extension mat (21) attached to the mat (11). The extension mat (21) is configured to move relative to the mat (11).

The diaper change mat according to the present invention preferably includes kneepads (81, 91) attached to the mat (11). In this case, the mat (11) has a substantially rectangular shape with a short side (11*y*) and a long side. The kneepads (81, 91) are respectively attached to two corners. The two corners are two of four corners of the mat (11), and placed at both ends of the short side (11*y*). The kneepads (81, 91) are preferably configured to move relative to the mat (11).

The diaper change mat according to the present invention preferably includes a pocket (35 to 38, 61, 71) attached to the mat (11).

In the diaper change mat according to the present invention, the mat (11) preferably includes a slip stopper (110) for preventing the mat (11) from slipping on a floor.

Alternatively, a diaper change mat according to the present invention includes a main body of the mat, (10) configured to be folded and a carrying bag (51) configured to accommodate the main body of the mat, (10). In this case, the main body of the mat, (10) is preferably coupled to inside of the carrying bag (51).

Still alternatively, a diaper change mat according to the present invention includes a main mat (11) and an extension mat (21) attached to the main mat (11). In this case, the extension mat (21) is preferably configured to move relative to the main mat (11).

In the diaper change mat according to the present invention, the main mat (11) preferably has a substantially rectangular shape with short sides and long sides (11*x*, 11*z*). Also, the extension mat (21) is preferably configured to move in a direction parallel to the long sides (11*x*, 11*z*) with respect to the main mat (11).

Yet alternatively, a diaper change mat according to the present invention includes a main mat (11) and kneepads (81, 91) attached to the main mat (11). The main mat (11) has a substantially rectangular shape with a short side (11*y*) and a long side. The kneepads (81, 91) are respectively attached to two corners. The two corners are two of four corners of the main mat (11), and placed at both ends of the short side (11*y*). Also, the kneepads (81, 91) are preferably configured to move relative to the main mat (11).

The diaper change mat according to the present invention preferably includes fixing portions (94 to 96) for detachably fixing a kneepad (81, 91) to the main mat (11). The fixing portions (94 to 96) fix the kneepad (81, 91) to a first position (95) and to a second position (96) other than the first position (95) of the main mat (11).

Further alternatively, a diaper change mat according to the present invention includes a main mat (11) and a pocket (35 to 38, 61, 71) attached to the main mat (11).

On the diaper change mat according to the present invention, the pocket (37, 38) preferably includes a first portion (31, 33) and a second portion (32, 34). Each of the first portion (31, 33) and the second portion (32, 34) is a sheet-like member. In each of the first portion (31, 33) and the second portion (32, 34), three sides (33*a*, 33*b*, and 33*c*, or 34*b*, 34*c*, and 34*d*) of the sheet-like member are fixed on a front surface of the main mat (11), and a remaining one side forms an opening portion (33*c*, 34*a*) without being fixed on the main mat (11). Also, the first portion (31, 33) and the second portion (32, 34) are adjacently arranged with their opening portions (33*c* and 34*a*) oriented toward each other. The front surface of the main mat (11) is one of two principal surfaces of the main mat (11).

Still further alternatively, a diaper change mat according to the present invention includes a main mat (11) and a slip stopper (110) provided on a back surface of the main mat (11). The slip stopper (110) prevents the main mat (11) from slipping on a floor.

According to the present inventions a diaper change mat is provided which has excellent workability and helps facilitate changing diapers.

BEST MODE FOR CARRYING OUT THE INVENTION

Referring to the attached drawings, embodiments of a diaper change mat of the present invention will be described below.

Figure 1:
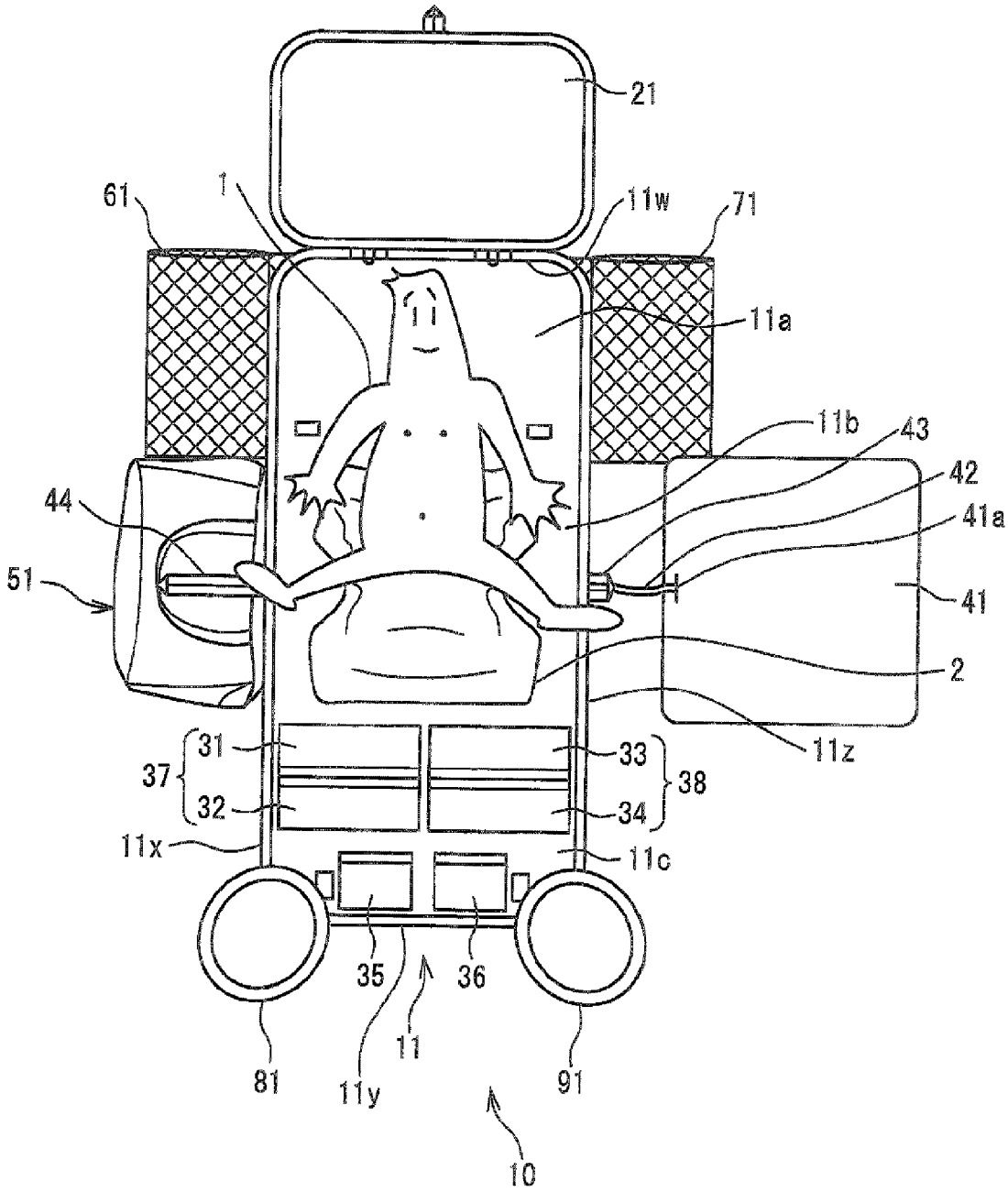
FIG. 1 is a view showing a diaper change mat according to an embodiment of the present invention when in use.

FIG. 1 shows a diaper change mat according to an embodiment of the present invention when in use. The diaper change mat according to the embodiment of the present invention includes a main body of the diaper change mat, 10 and a carrying bag 51 to accommodate the main body of the diaper change mat, 10. The main body of the diaper change mat, 10 includes a main mat 11, an extension mat 21, kneepads 81 and 91, and a protecting cover 41. The main mat 11 has a substantially rectangular shape, and has three portions, i.e., an upper portion of the main mat, 11*a*, a central portion of the main mat, 11*b*, and a lower portion of the main mat, 11*c*, into which the main mat 11 is equally separated along its long sides. The upper portion of the main mat, 11*a*, the central portion of the main mat, 11*b*, and the lower portion of the main mat, 11*c* are arranged in this order. The extension mat 21 has almost the same shape as the upper portion of the main mat, 11*a*, and overlaps on the upper portion of the main mat, 11*a* in an unextended state. The extension mat 21 is attached to the upper portion of the main mat, 11*a* such that the extension mat 21 moves in the direction parallel to the long sides of the main mat 11. FIG. 1 shows a state of the extension mat 21 being fully drawn to extend the mat.

The main mat 11 and the extension mat 21 have a cushioning property and their surfaces are formed of material, which is good in terms of touch and has water-absorbing property, such as cotton pile fabric. Also, the main body of the mat, 10 is foldable.

In the present description, each of the main mat 11, extension mat 21, and kneepads 81 and 91 has two principal surfaces. One of the two principal surfaces faces upward upon use of the diaper change mat (see FIG. 1) and is referred to as the front surface, and the other surface faces downward is referred to as the back surface.

Spare diaper bags 61 and 71 are attached to the upper portion of the main mat, 11*a*. Each of the spare diaper bags can be in either a spread state shown in FIG. 1 or a folded state. The folded state will be described below.

The carrying bag 51 and a belt 44 are attached to a portion of a second peripheral edge 11*x* forming one of long sides of the main mat 11, and the portion belongs to the central portion of the main mat, 11*b*. The main mat 11 is coupled to the inside of the carrying bag 51 by sewing. The belt 44 has a button hole at its tip. The belt 44 engages with a button 45 which is described later. A protecting cover attaching loop 43 is provided at a portion of a fourth peripheral edge 11*z* forming the other of the long sides of the main mat, and the portion belongs to the central portion of the main mat, 11*b*. A position at which the protecting cover attaching loop 43 is provided and that at which the belt 44 is attached are symmetrical with respect to a center line parallel to the long sides of the main mat 11. The protecting cover 41 is attached to the protecting cover attaching loop 43 via a connection 42. The connection 42 is a string or tape member, and extends through the protecting cover attaching loop 43 and a slit hole 41*a* of the protecting cover 41.

The front surface of the lower portion of the main mat, 11*c* is provided with pockets 35 to 38. Also, the kneepads 81 and 91 are respectively attached to two corners of the lower portion of the main mat, 11*c*. The two corners are placed at both ends of a third peripheral edge 11*y* that is one of the short sides of the main mat 11. The kneepads 81 and 91 can move relative to the lower portion of the main mat, 11*c*. Also, the kneepads 81 and 91 have a cushioning property.

In FIG. 1, a baby or infant 1 lies face up on the main mat 11. A head and a hip of the baby or infant 1 are placed on the upper portion of the main mat, 11*a* and the central portion of the main mat, 11*b*, respectively. Between the hip of the baby or infant 1 and the central portion of the main mat, 11*b*, a diaper 2 is laid in a spread manner. When the diaper change mat is laid on a floor, a diaper changer, such as a mother, changes diapers for the baby or infant 1 in a posture in which both of the knees are respectively placed on the kneepads 81 and 91.

Figure 2:
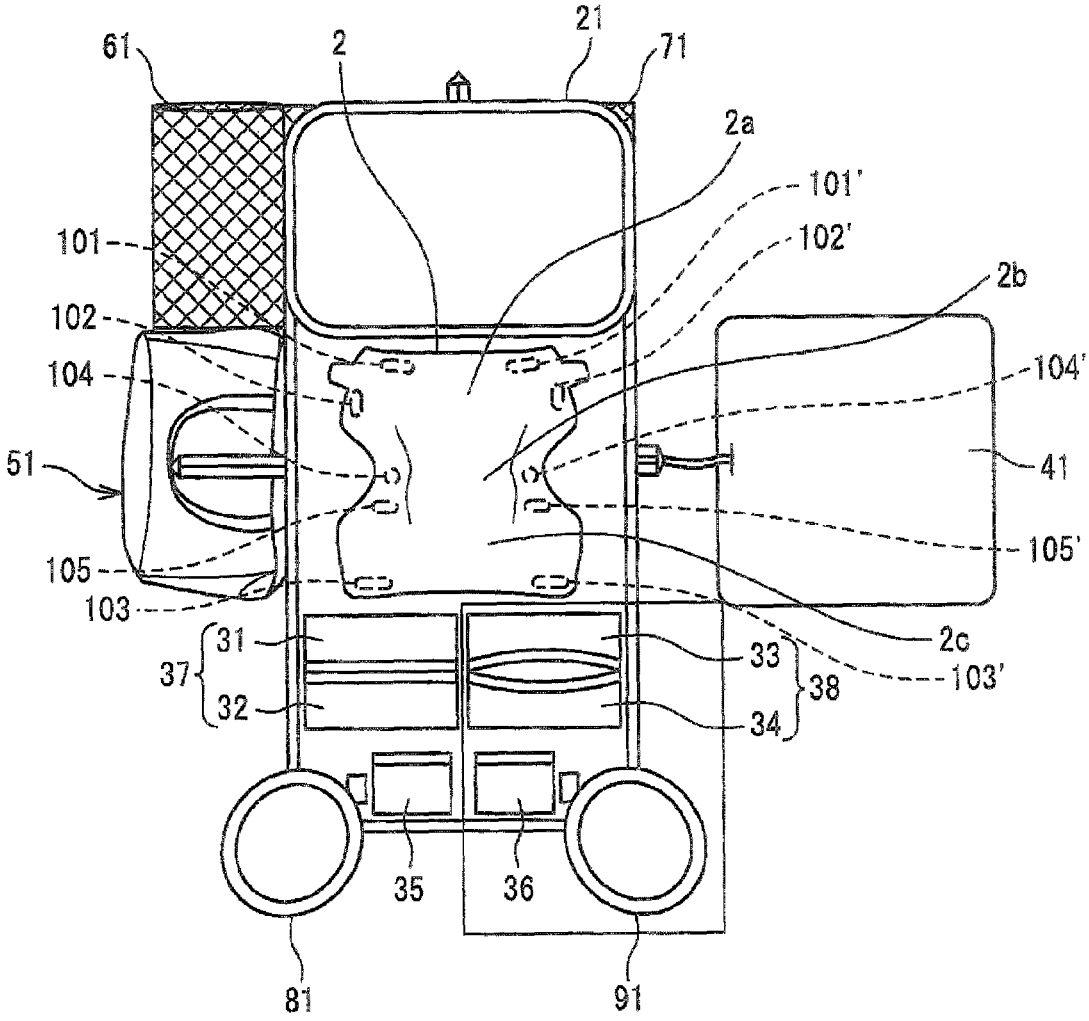
FIG. 2 is a front view of the diaper change mat according to the embodiment of the present invention.

FIG. 2 shows a front view of the diaper change mat according to the embodiment of the present invention. In FIG. 2, the extension mat 21 overlaps on the upper portion of the main mat, 11*a*. The spare diaper bag 71 is in the folded state of being folded behind the upper portion of the main mat, 11*a*.

The front surface of the central portion of the main mat, 11*b* is provided with surface fasteners 101 to 105 and 101' to 105'. The surface fasteners 101, 102, 101', and 102' are placed nearer to the upper portion of the main mat, 11*a* than the surface fasteners 104, 105, 104', and 105', and the surface fasteners 103 and 103' are placed nearer to the lower portion of the main mat, 11*c* than the surface fasteners 104, 105, 104', and 105'. Positions of the surface fasteners 101, 102, 101', and 102' are determined to fix the back body 2*a* of the diaper 2; positions of surface fasteners 104, 105, 104', and 105' are determined to fix gather portions provided on both sides of a crotch portion 2*b* of the diaper 2 with the gather portions being stretched; and positions of surface fasteners 103 and 103' are determined to fix a front body 2*c* of the diaper 2. The surface fasteners 101 to 105 and surface fasteners 101' to 105', which are respectively corresponding to the surface fasteners 101 to 105 in reference numerals, are symmetrically placed, respectively, with respect to the center line parallel to the long sides of the main mat 11. Because the surface fasteners 101 to 105 and 101' to 105' are symmetrical in their positions with respect to the center line of the main mat 11 as described, the diaper 2 can be fixed on the main mat 11 in a spread manner in the right and left direction.

As the surface fasteners 101 to 105 and 101' to 105', convex members of publicly known (commercially available) surface fasteners can be used. The convex member of the surface fastener is a sheet provided with many engaging members of convex shape such as a hooked or mushroom shaped. The surface fasteners 101 to 105 and 101' to 105' are fastened detachably to nonwoven fabric employed for a surface of a back sheet of a disposable diaper of unfolded type. Here, the surface of the back sheet corresponds to an outer surface of the diaper 2, which faces to and contacts with the front surface of the main mat 11 as shown in FIGS. 1 and 2.

The surface fasteners 101 to 105 and 101' to 105' can fix the diaper 2 on the main mat 11 with the diaper 2 being longitudinally and laterally spread, and facilitating changing diapers.

As shown in FIG. 2, the surface fasteners 101, 103, 105, 101', 103', and 105' occupy a certain area extending in the direction parallel to the short sides of the main mat 11. Moreover, the surface fasteners 101 (101') and 102 (102') for fixing the back body 2*a* of the diaper 2 are provided in different positions along the direction parallel to the long sides of the main mat 11. Similarly, the surface fasteners 104 (104') and 105 (105') for fixing the gather portions of the diaper 2 are provided in different positions along the direction parallel to the long side of the main mat 11. Therefore, the diaper change mat according to the embodiment of the present invention can fix diapers of various sizes on the main mat 11.

The protecting cover 41 has a substantially rectangular sheet shape, and its size is slightly smaller than that of the front surface of the central portion of the main mat, 11*b*. Accordingly, the protecting cover 41 can be placed on the front surface of the central portion of the main mat, 11*b* to cover all of the surface fasteners 101 to 105 and 101' to 105' without protruding from the central portion of the main mat, 11*b*. One surface (fastening surface) of the protecting cover 41 is formed of nonwoven fabric which can be fastened to the surface fasteners 101 to 105 and 101' to 105'. The fastening surface of the protecting cover 41 is detachably fastened to the surface fasteners 101 to 105 and 101' to 105'. When the diaper change mat according to the embodiment of the present invention is not in use, the protecting cover 41 is being kept fastened to the surface fasteners 101 to 105 and 101' to 105'. The protecting cover 41 protects the surface fasteners 101 to 105 and 101' to 105' from the adhesion of dirt and dust. Thus, the performance of the surface fasteners 101 to 105 and 101' to 105' to fix the diaper 2 is prevented from reducing. Also, instructions to use the diaper change mat according to the embodiment of the present invention may be described on a surface opposite to the fastening surface of the protecting cover 41.

Figure 3:
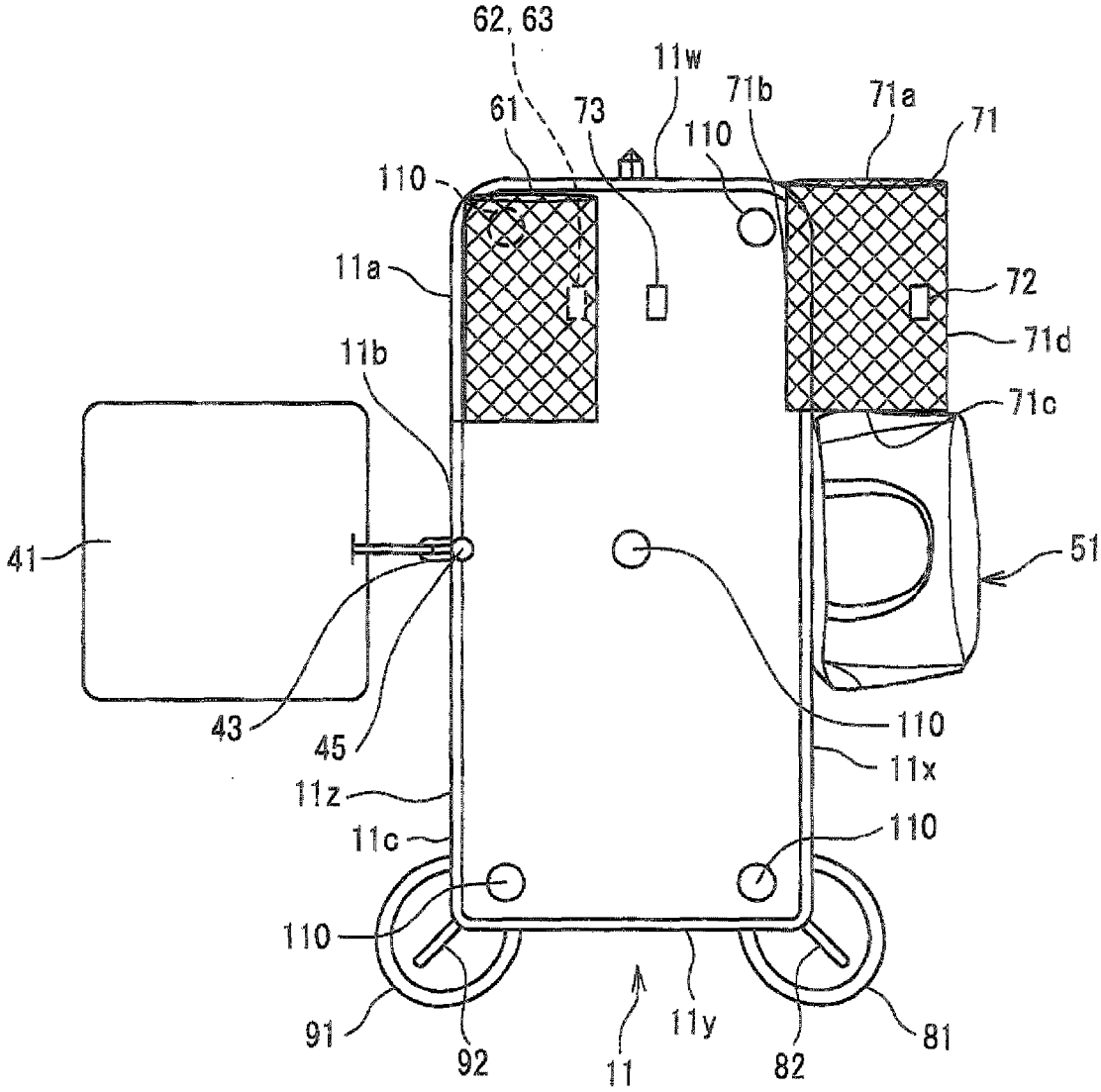
FIG. 3 is a back view of the diaper change mat according to the embodiment of the present invention.

FIG. 3 shows the back view of the diaper change mat according to the embodiment of the present invention shown in FIG. 2. The spare diaper bags 61 and 71 are bags of substantially rectangular shapes formed of mesh fabric. The spare diaper bag 71 is fixed at its side portion 71*b* to a portion of the second peripheral edge 11*x* with its bottom portion 71*c* oriented toward the lower portion of the main mat, 11*c* and its opening 71*a* oriented in the opposite direction, and the portion belongs to the upper portion of the main mat, 11*a*. Of the side portions of the spare diaper bag 71, a side portion 71*d* is not fixed to the second peripheral edge 11*x* and is a free end. The spare diaper bag 61 is attached to the upper portion of the main mat, 11*a* in the same manner as the spare diaper bag 71. The back surface of the upper portion of the main mat, 11*a* is provided with surface fasteners 63 and 73 for respectively fixing the spare diaper bags 61 and 71 in their folded state, and the spare diaper bags 61 and 71 are respectively provided with surface fasteners 62 and 72 for engaging with surface fasteners 63 and 73. The surface fasteners 62 and 63 engage with each other detachably and the surface fasteners 72 and 73 engage with each other detachably. In FIG. 3, the spare diaper bag 61 is in a folded state, whereas the spare diaper bag 71 is in a non-folded state.

Each of the spare diaper bags 61 and 71 can accommodate three diapers, i.e., in total, both can accommodate six diapers. When the spare diaper bags 61 and 71 accommodate diapers, and are folded behind the upper portion of the main mat, 11*a*, they and the upper portion of the main mat, 11*a* serve as a pillow or cushion. When the spare diaper bags 61 and 71 are spread in a right and left outward direction as shown in FIG. 1, the main mat 11 is flattened, and the diapers can be easily taken out of the spare diaper bags 61 and 71.

On the diaper change mat according to the embodiment of the present invention, slip stoppers 110 are respectively provided at the center and four corners of the back surface of the main mat 11. The slip stoppers 110 are formed by fixing thin and soft rubber sheets onto the back surface of the main mat 11. Because the main mat 11 is prevented from slipping on the floor, the main mat 11 is kept spread even if the baby or infant 1 actively squirms when changing diapers.

On the back surface of the main mat 11, the button 45 is attached to a portion of the fourth peripheral edge 11*z*, at which the protecting cover attaching loop 43 is attached.

Figure 4:
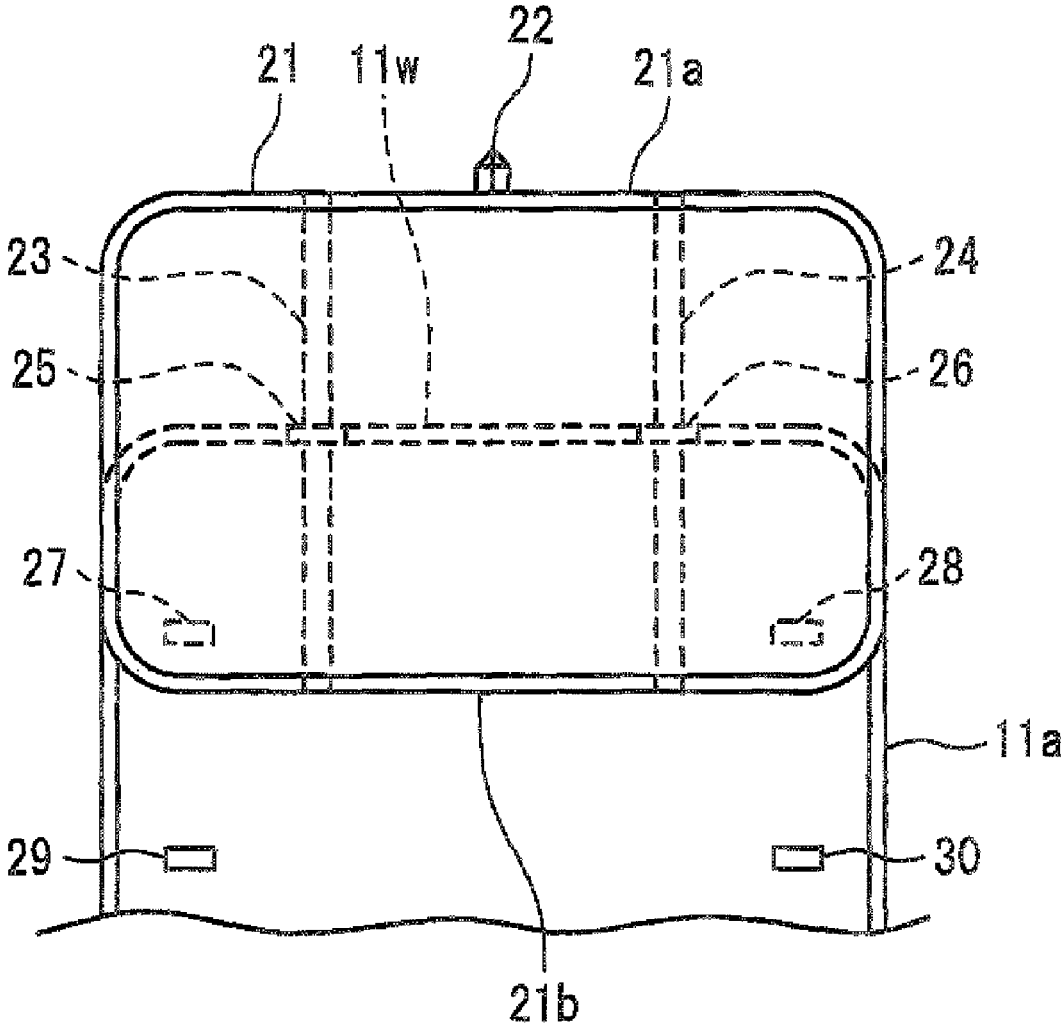
FIG. 4 is a view illustrating an attachment state between a main mat and an extension mat of the diaper change mat according to the embodiment of the present invention.

An attachment state between the main mat 11 and the extension mat 21 of the diaper change mat according to the embodiment of the present invention will be described with reference to FIG. 4. In FIG. 4, the main mat 11 and the extension mat 21 are viewed from the side of the front surface, and the spare diaper bags 61 and 71 are omitted. On the front surface of the upper portion of the main mat, 11*a*, tape members 25 and 26 are attached to a first peripheral edge 11*w* forming the short side of the main mat 11 such that the tape members 25 and 26 are along the first peripheral edge 11*w*. The tape members 25 and 26 are respectively fixed at their both ends to the upper portion of the main mat, 11*a*, and there is space between the portion other than both ends of each of the tape members 25 and 26 and the upper portion of the main mat, 11*a*. Tape members 23 and 24 extend respectively through the spaces. Both ends of each of the tape members 23 and 24 are respectively fixed to an upper peripheral edge 21*a* and a lower peripheral edge 21*b* of the extension mat on the back surface of the extension mat 21. Because the tape members 23 and 24 extend in the direction parallel to the long sides of the main mat 11, the extension mat 21 can move in a direction parallel to the long sides of the main mat 11. In order to fix the extension mat 21 to the upper portion of the main mat, 11*a* in an unextended state, surface fasteners 29 and 30 are provided on the front surface of the upper portion of the main mat, 11*a*, and also surface fasteners 27 and 28 for respectively engaging detachably with the surface fasteners 29 and 30 are provided on the back surface of the extension mat 21.

On the diaper change mat according to the embodiment of the present invention, the length of the mat is adjusted easily by drawing the extension mat 21. Accordingly, the diaper change mat according to the embodiment of the present invention can be used for a plurality of babies or infants of different body sizes. This is advantageous when one goes out with a plurality of babies or infants. Also, by extending the length of the mat in accordance with the growth of a baby or infant, the diaper change mat according to the embodiment of the present invention can be used for a long period of time.

Moreover, the extension mat 21 is provided with a toy attaching loop 22 on the upper peripheral edge 21*a*. A favorite toy (not shown) of the baby or infant 1 can be freely attached to the toy attaching loop 22. Changing diapers is facilitated by attracting and amusing the baby or infant 1 with the toy.

Figure 5:
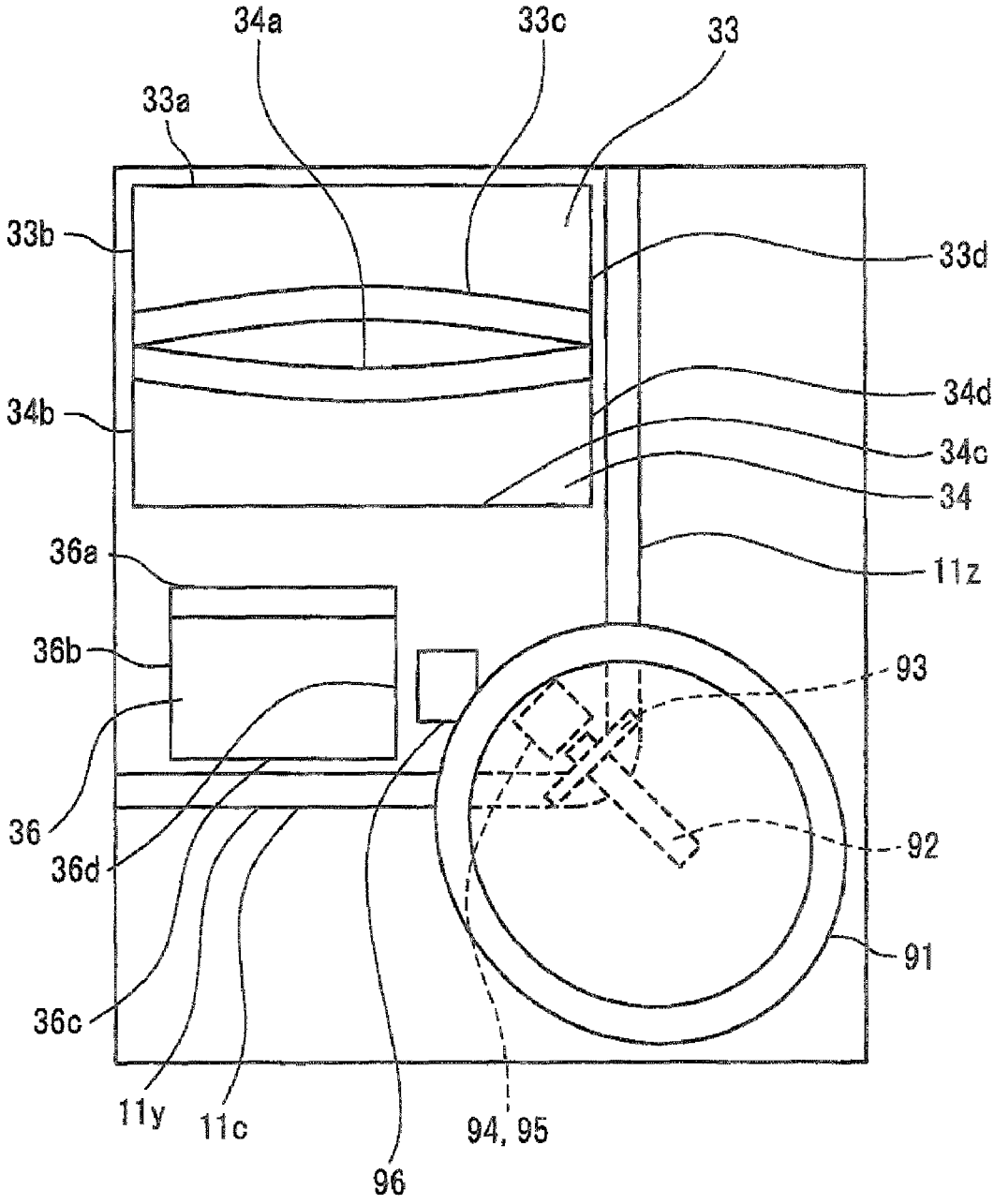
FIG. 5 is an enlarged view showing a lower portion of the main mat of the diaper change mat according to the embodiment of the present invention.

FIG. 5 is an enlarged view showing FIG. 2 inside a box. The pocket 38 includes a pocket upper portion 33 and a pocket lower portion 34. The pocket upper portion 33 is a sheet-like member having a substantially rectangular shape; its three sides, i.e., its side portions 33*b* and 33*d* and bottom portion 33*a*, are fixed closely on the front surface of the lower portion of the main mat, 11*c*; and the remaining one side forms an opening portion 33*c* without being fixed on the lower portion of the main mat, 11*c*. The pocket lower portion 34 is a sheet-like member having the same shape as the pocket upper portion 33; its three sides, i.e., its side portions 34*b* and 34*d* and bottom portion 33*c*, are fixed closely on the front surface of the lower portion of the main mat, 11*c*; and the remaining one side forms an opening portion 34*a* without being fixed on the lower portion of the main mat, 11*c*. The pocket upper and lower portions 33 and 34 are adjacently arranged with the opening portions 33*c* and 34*a* oriented toward each other. The pocket 37 includes a pocket upper portion 31 and a pocket lower portion 32, and has the same structure as pocket 38. The pockets 37 and 38 are symmetrically arranged with respect to the center line parallel to the long sides of the main mat 11. The pockets 37 and 38 can accommodate baby wipes and garbage bags for used diapers. Structures of the pockets 37 and 38 enable the baby wipes and the garbage bags to be taken out one by one with one hand. The diaper changer can prepare the baby wipes in the pocket 37 or 38 on the side of the main hand of the diaper changer.

The pockets 35 and 36 will be described. The pocket 36 has a substantially rectangular shape; its three sides, i.e., its side portions 36*b* and 36*d* and bottom portion 36*c*, are fixed closely on the front surface of the lower portion of the main mat, 11*c*; and the remaining one side forms an opening portion 36*a* without being fixed on the lower portion of the main mat, 11*c*. The pocket 35 has the same shape as pocket 36; its three sides are fixed on the front surface of the lower portion of the main mat, 11*c*; and the remaining one side forms an opening portion without being fixed on the lower portion of the main mat, 11*c*. The pockets 35 and 36 are symmetrically arranged with respect to the center line parallel to the long sides of the main mat 11. The pockets 35 and 36 can accommodate tools for cleaning ears as well as small articles relevant to changing diapers, such as baby powder, diaper rash ointment, and cotton swabs.

A state of attachment between each of the kneepads 81 and 91 and the lower portion of the main mat, 11*c* is described. A tape member 93 is fixed on the front surface of one of two corners of the main mat 11 placed at both ends of the third peripheral edge 11*y*. The tape member 93 is fixed at its one end to the fourth peripheral edge 11*z*, and at the other end to the third peripheral edge 11*y*, and there is a space between the middle portion of the tape member 93 and the lower portion of the main mat, 11*c*. A tape member 92 extends through the space between the middle portion of the tape member 93 and the lower portion of the main mat, 11*c*, and its both ends are fixed on the back surface of the kneepad 91. Surface fasteners 95 and 96 are provided at different positions on the front surface of the lower portion of the main mat, 11*c*, and a surface fastener 94 capable of detachably engaging with the surface fastener 95 or 96 is provided on the back surface of the kneepad 91. In FIG. 5, the surface fasteners 94 and 95 engage with each other. The kneepad 81 is attached on the front surface of the other one of the two corners of the main mat 11 placed at both ends of the third peripheral edge 11*y*, in the same manner as the kneepad 91.

As is clear from the structures above described, the kneepads 81 and 91 can move relative to the lower portion of the main mat, 11*c*. More specifically, each of the kneepads 81 and 91 is capable of translation along the front surface of the main mat 11 and rotation around an axis perpendicular to the front surface of the main mat 11. Further more, with the surface fasteners, the kneepads 81 and 91 can be fastened to various positions (95 or 96) of the lower portion of the main mat, 11*c* to be detachably fixed. Accordingly, the positions of the kneepads 81 and 91 can be adjusted in accordance with the body size of the diaper changer. When the diaper change mat is not in use, the kneepads 81 and 91 can be withdrawn so as not to protrude from the main mat 11.

Because the kneepads 81 and 91 have a cushioning property, pain in the knees of the diaper changer is relieved upon changing diapers. Accordingly, the diaper change mat according to the embodiment of the present invention is suitable for outdoor use or use on a hard floor. Also, the diaper changer can place his or her knees on the kneepads 81 and 91 to thereby fix the main mat 11 on the ground, floor, or the like, with the use of his or her weight.

On the diaper change mat according to the embodiment of the present invention, the main body of the mat, 10 can be folded and packed in the carrying bag 51. This procedure will be described below.

Figure 6:
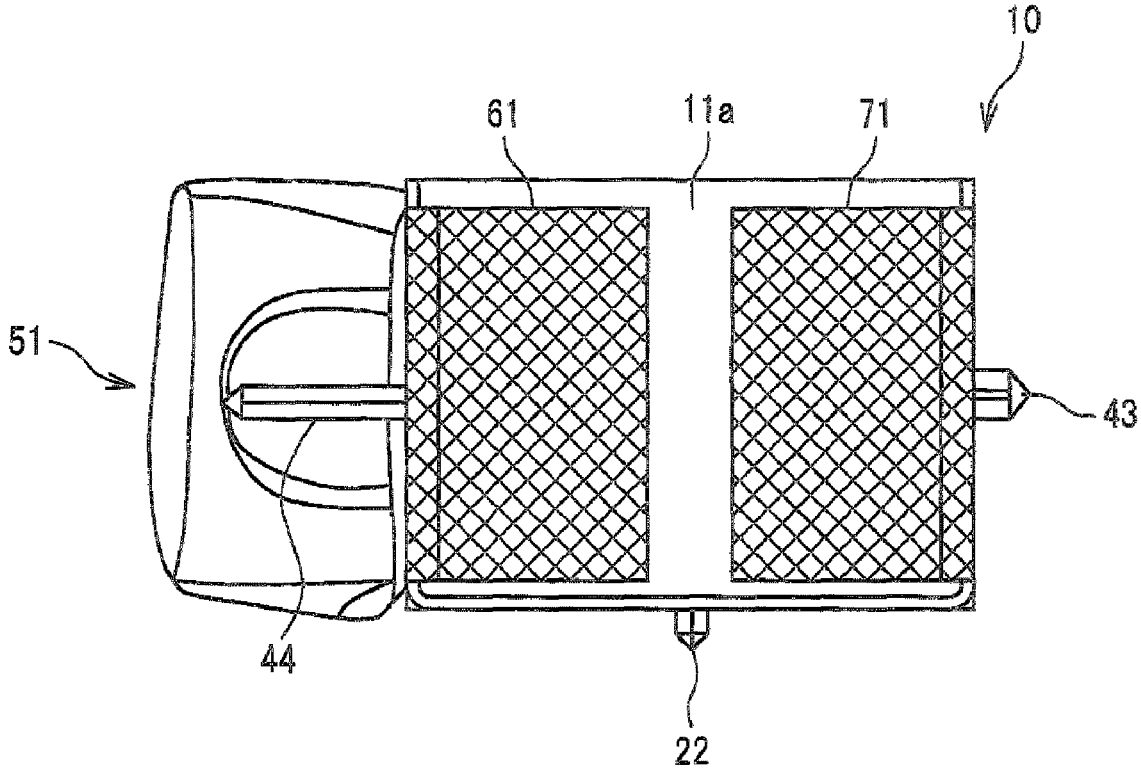
FIG. 6 is a view showing the diaper change mat according to the embodiment of the present invention in a state of a main body of the mat being folded part the way.

The diaper 2 is first removed from the diaper change mat shown in FIG. 2. Next, the protecting cover 41 is fastened on the surface fasteners 101 to 105 and 101' to 105'. Then, the spare diaper bags 61 and 71 are folded behind the upper portion of the main mat, 11*a*, and also the kneepads 81 and 91 are withdrawn so as not to protrude from the main mat 11. Subsequently, the lower portion of the main mat, 11*c* is folded such that the front surface of the lower portion of the main mat, 11*c* faces to the front surface of the central portion of the main mat, 11*b*. After that, the upper portion of the main mat, 11*a* is folded such that the front surface of the upper portion of the main mat, 11*a* faces to the back surface of the lower portion of the main mat, 11*c*. FIG. 6 shows the diaper change mat having been folded so far.

Figure 7:
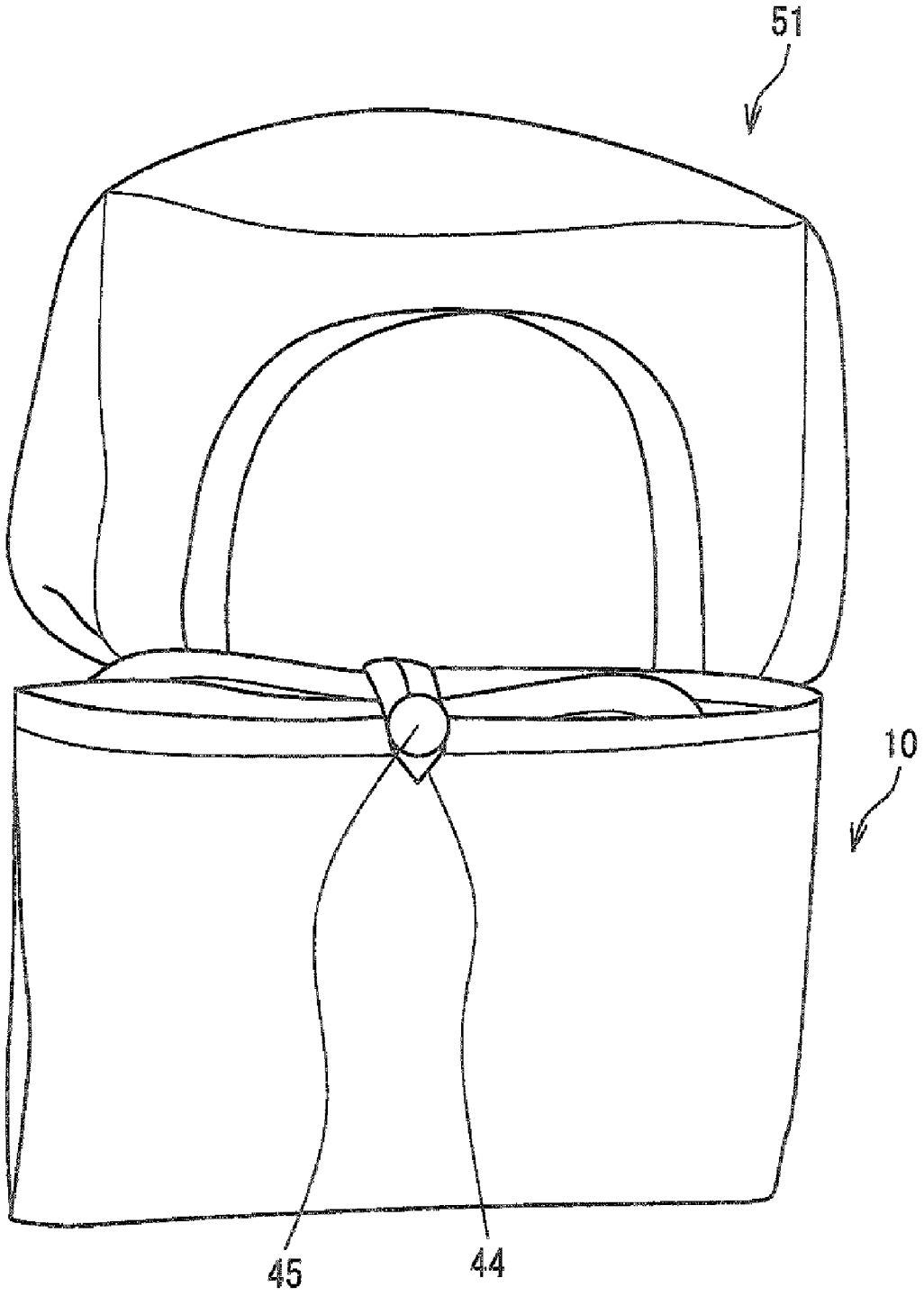
FIG. 7 is a view showing the diaper change mat according to the embodiment of the present invention in a state of the main body of the mat having been folded.

Further more, the portion to which the belt 44 is attached and that to which the protecting cover attaching loop 43 is attached are overlapped with each other such that the back surface of the upper portion of the main mat, 11*a* faces inside, and then the button 45 is fastened into the button hole of the belt 44. FIG. 7 shows the diaper change mat with the button being fastened.

Figure 8:
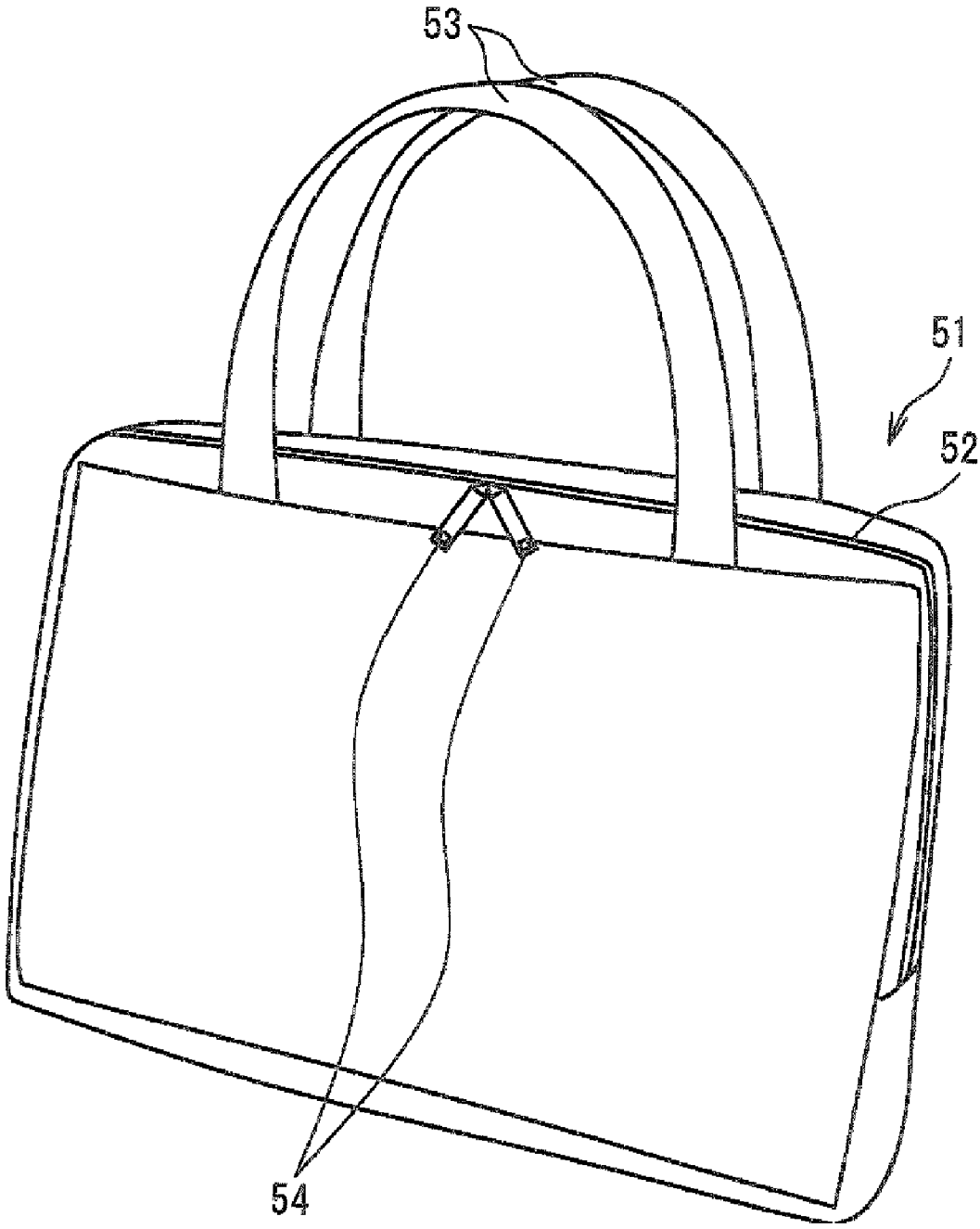
FIG. 8 is a view showing the diaper change mat according to the embodiment of the present invention in a state of the main body of the mat being packed in a carrying bag.

Finally, the main body of the mat, 10 is packed in the carrying bag 51, FIG. 8 shows the diaper change mat with the main body of the mat, 10 being packed in the carrying bag 51. The opening 52 of the carrying bag 51 can be freely opened and closed with a slide fastener). Also, there are two sliders 54 for opening or closing the opening 52, and thus, the main body of the mat, 10 can be easily packed or taken out. Further more, the carrying bag 51 is attached with handles 53. Accordingly, the diaper change mat according to the embodiment of the present invention may be carried in a hand in a state shown in FIG. 8, or when it is carried in another bag, it can be easily taken out of the other bag because of the handles 53.

On the diaper change mat according to the embodiment of the present invention, while the baby or infant is held with one hand, the main body of the mat, 10 can be taken out of the carrying bag 51 and unfolded with the other hand, or, folded and packed in the carrying bag 51 with the other hand.

The diaper change mat according to the embodiment of the present invention is washable. Also, if the surfaces of the main mat 11, the extension mat 21, the pockets 35 to 38, and the like are waterproofed, dirt can immediately be wiped away from there. Consequently, the diaper change mat according to the embodiment of the present invention can be always used in a clean condition.

When the diaper change mat according to the embodiment of the present invention is used, a person who has little experience with changing diapers, such as a father who has just had his first child, can easily change diapers, since the surface fasteners 101 to 105 and 101' to 105' provide marks indicating a place where a diaper should be put on and fixed to in a spread manner. The father can acquire confidence in child care through a success in changing diapers at the start of his role as a child career. As a result, the father spends longer time with his child.

The diaper change mat according to the embodiment of the present invention can be used not only in changing diapers for a baby or infant but also in changing diapers for an adult such as the sick or elderly.

The invention claimed is:

1. A diaper change mat comprising:

a main mat; and an extension mat or kneepad attached to said main mat such that said extension mat or kneepad moves relative to said main mat, wherein both ends of a first tape member are fixed to said main mat, a second tape member extends through a space between a middle portion of said first tape member and said main mat, and both ends of said second tape member are fixed to said extension mat or kneepad.

2. The diaper change mat according to claim 1, further comprising:

a surface fastener configured to be fastened detachably to a diaper, wherein said surface fastener is fixed on said main mat.

3. The diaper change mat according to claim 2, further comprising:

a protecting cover attached to said main mat, wherein said protecting cover includes a fastening surface formed of nonwoven fabric which is fastened detachably to said surface fastener, and said protecting cover is configured to cover said surface fastener.

4. The diaper change mat according to claim 3, wherein said protecting cover includes another surface opposite to said fastening surface, and instructions to use the diaper change mat are described on said another surface.

5. The diaper change mat according to claim 1, further comprising:

a carrying bag configured to accommodate said main mat, wherein said main mat is configured to be folded, and said main mat is coupled to inside of said carrying bag.

6. The diaper change mat according to claim 5, further comprising:

a belt which has a button hole and is attached to a first portion of a first edge of said main mat; and a button which is configured to be fastened into said button hole and is attached to a second portion of a second edge of said main mat, wherein said main mat is configured to be folded such that said first portion and said second portion are overlapped, and said first portion is coupled to said inside of said carrying bag.

7. The diaper change mat according to claim 1, further comprising:

a pocket attached to said main mat.

8. The diaper change mat according to claim 1, further comprising:

a slip stopper provided on a back surface of said main mat.

9. A diaper change mat comprising:

a surface fastener configured to be fastened detachably to a diaper;

a mat on which said surface fastener is fixed; and a protecting cover attached to said mat via a connecting member, wherein said protecting cover includes a fastening surface formed of nonwoven fabric which is fastened detachably to said surface fastener, said connecting member is not a surface fastener configured to be fastened detachably to a diaper, and said protecting cover is configured to cover said surface fastener.

10. The diaper change mat according to claim 9, wherein said protecting cover includes another surface opposite to said fastening surface, and instructions to use the diaper change mat are described on said another surface.

* * * * *